US009903078B2

(12) United States Patent
Ali

(10) Patent No.: US 9,903,078 B2
(45) Date of Patent: Feb. 27, 2018

(54) THREE DIMENSIONAL PAVING

(71) Applicant: Hesham Ali, Miami, FL (US)

(72) Inventor: Hesham Ali, Miami, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 151 days.

(21) Appl. No.: 15/018,152

(22) Filed: Feb. 8, 2016

(65) Prior Publication Data

US 2017/0226709 A1 Aug. 10, 2017

(51) Int. Cl.

| | |
|---|---|
| ***E01C 23/07*** | (2006.01) |
| ***E01C 19/20*** | (2006.01) |
| ***E01C 19/48*** | (2006.01) |
| ***E01C 19/00*** | (2006.01) |

(52) U.S. Cl.

CPC ..... *E01C 23/07* (2013.01); *E01C 19/002* (2013.01); *E01C 19/20* (2013.01); *E01C 19/48* (2013.01)

(58) Field of Classification Search

CPC ..... E01C 23/07; E01C 19/002; E01C 19/20; E01C 19/48

See application file for complete search history.

(56) References Cited

U.S. PATENT DOCUMENTS 5,236,275 A * 8/1993 Kneeland ..... E01C 19/4826 404/107
5,333,969 A * 8/1994 Blaha ..... E01C 19/46 404/102
5,419,654 A * 5/1995 Kleiger ..... E01C 19/46 366/22
5,471,391 A * 11/1995 Gudat ..... E01C 19/004 340/995.1
5,584,597 A * 12/1996 Lemelson ..... E01C 23/06 299/41.1
5,646,844 A * 7/1997 Gudat ..... E01C 19/004 701/409
5,771,978 A 6/1998 Davidson
6,520,715 B1 2/2003 Smith
6,988,849 B1 * 1/2006 Zimmerman ..... E01C 23/06 404/75
7,484,911 B2 * 2/2009 Frelich ..... E01C 19/48 222/71
7,899,598 B2 3/2011 Woon et al.
7,946,787 B2 * 5/2011 Glee ..... E01C 19/004 404/75
8,167,513 B2 * 5/2012 Ryan ..... E01C 23/06 404/101

(Continued)

*Primary Examiner* — Abigail A Risic

(74) *Attorney, Agent, or Firm* — Saliwanchik, Lloyd & Eisenschenk

(57) ABSTRACT

The subject invention provides methods of preparing and/or modifying a working area of interest that results in a level surface layer. In preferred embodiments, a three-dimensional (3-D) paver is utilized to deposit a compressible paving material, wherein, prior to being compacted mechanically, the pavement has a thickness that varies in accordance with the topography of the subgrade surface. Advantageously, paving methods comprising 3-D printing technology provided herein offer a more effective, economical, and versatile solution in preparing level road surface layers than existing paving machines.

19 Claims, 3 Drawing Sheets

(56) References Cited

U.S. PATENT DOCUMENTS

| | | | | |
|---|---|---|---|---|
| 8,282,312 | B2 * | 10/2012 | Braddy | E01C 19/182 404/108 |
| 8,371,769 | B2 | 2/2013 | Worsley et al. | |
| 8,696,237 | B2 | 4/2014 | Hanfland et al. | |
| 8,930,092 | B2 * | 1/2015 | Minich | E01C 23/07 404/84.1 |
| 9,303,368 | B2 * | 4/2016 | Reda | G05D 1/0011 |
| 2003/0142579 | A1 * | 7/2003 | Throop | B28C 7/06 366/3 |
| 2004/0161299 | A1 * | 8/2004 | Smith | E01C 23/07 404/75 |
| 2006/0045620 | A1 * | 3/2006 | Olson | E01C 19/48 404/84.1 |
| 2009/0317186 | A1 * | 12/2009 | Glee | E01C 19/004 404/75 |
| 2010/0129152 | A1 * | 5/2010 | Taylor | E01C 23/07 404/75 |
| 2012/0263530 | A1 * | 10/2012 | Buschmann | E01C 19/00 404/72 |
| 2013/0051913 | A1 | 2/2013 | Eul | |
| 2016/0032536 | A1 * | 2/2016 | Reda | G05D 1/0011 404/75 |
| 2016/0032540 | A1 * | 2/2016 | Reda | E01C 11/005 404/75 |

* cited by examiner

THREE DIMENSIONAL PAVING

BACKGROUND OF INVENTION

A paving machine typically comprises a tractor or towing vehicle that moves ahead of a screed over a subgrade to be paved. The screed is a steel plate that has a two-dimensional slope that controls the contour of the finished pavement surface. The paving machine deposits a layer of asphalt or other paving material on the subgrade, and the thickness and contour of the asphalt layer are determined by a "floating" screed that is towed behind the towing vehicle. The screed smooths the top surface of the layer of the paving material, while at the same time controlling the vertical position of this surface and the thickness of the asphalt layer.

A paving machine deposits the paving material on the subgrade so that the top surface of the paving material follows a desired elevation contour. In some instances, the top surface of the asphalt is contoured in relation to an adjacent reference surface. In other cases, the asphalt is contoured to match a reference set by a surveyor. In all of these instances, it is necessary that the vertical position of the top surface of the deposited paving material be controlled precisely with respect to a reference of some sort, and this requires that the tow points of the tow arms be controlled with precision.

In other paving operations, the desired contour of the paved surface is defined in a three dimensional database, and the location of the paver, including the screed, is monitored by means of GPS receivers, laser receivers, automated total station systems, or similar systems. In these cases, the paver is operated to deposit a layer of paving material which matches in contour and thickness the parameters defined in the database.

Current paving technology that relies on the use of a screed can lead to variations in the thickness of deposited paving materials in comparison to the desired finished condition of the pavement. During deposition, paving materials can be smoothed by the screed to create a leveled surface. However, when compressible paving materials such as asphalt are subsequently compacted, the resulting pavement surface deforms and conforms to the profile of the underlying subgrade. Therefore, if surface defects and abnormalities such as depressions and humps exist in the subgrade, the same imperfections can be observed on the finished pavement, and can result in the formation of damaging structures such as potholes and bird bath. Furthermore, pooling water due to a lack of drainage on the surface of pavement having such defects can accelerate the damage of the pavements.

While the current state of the art allows precise evaluation of road surface topography, there still remains a need for optimizing the paving process such that surface defects can be minimized without incurring substantial engineering and reconstruction expenses.

BRIEF SUMMARY

The subject invention provides a method of preparing and/or modifying a working area of interest that results in a level surface layer.

In specific embodiments, a three-dimensional (3-D) printer is utilized to deposit a compressible paving material of choice, wherein, prior to being compacted mechanically, the pavement has a thickness that varies in accordance with the topography of the subgrade surface. Advantageously, paving methods comprising 3-D printing technology provided herein offer a more effective, economical, and versatile solution in preparing level road surface layers than existing paving machines.

In accordance with one aspect of the subject invention, a method of paving a surface layer of a working area is provided wherein the method comprises:

- creating a reference station in the vicinity of the working area;
- providing a three-dimensional (3-D) mapping of the topography of the working area using a scanner system, the topography comprising a collection of 3-D coordinates at the surface of the working area;
- determining the thickness of the paving material to be deposited based on the numeric comparison between the reference station and each of the 3-D coordinates of the measured topography of the working area, wherein the thickness data and variations thereof across the working area are stored in a computer memory;
- depositing at least one layer of a desired paving material onto the working area using a 3-D printer, the printer being controlled by the thickness data stored in the memory that is adjusted by a predetermined amount in accordance with the compressibility of the paving material; and
- mechanically compacting the deposited pavement to achieve a level surface layer over the working area.

In a preferred embodiment, the working area is a road surface.

In some embodiments, the 3-D scanner system can utilize a number of sensors and devices including, but not limited to, optical sensors, acoustic sensors, GPS systems, and automated total station systems. An exemplary embodiment provides that a LIDAR system can be used to measure the 3-D topography of the working area.

In some embodiments, the paving material is compressible. In other embodiments, the paving material is incompressible. In preferred embodiments, the compressibility of the paving material determines the thickness of the material to be deposited.

In specific embodiments, the thickness of the pavement that is deposited using methods provided herein can be as low as ⅜ of an inch.

In further embodiments, the 3-D printer comprises a positioning system and a dispensing system, wherein the positioning system is controlled electronically to move the nozzle tip in elevation as well as in longitudinal and transverse directions.

BRIEF DESCRIPTION OF DRAWINGS

FIG. 2A shows the new asphalt coming out of the screed of a conventional paver. When it is compacted, it compresses by about 20% of the asphalt initial thickness. The thickness is variable due to bridging depressions in the subgrade surface; therefore, thicker parts will compress more than thinner parts. The result is a surface that mirrors the subgrade profile, but to a lesser degree (FIG. 2B). FIG. 2C shows the surface to which asphalt is applied according to the current invention prior to compaction, whereas FIG. 2D shows the surface after compaction by rolling.

DETAILED DISCLOSURE

Figure 1:
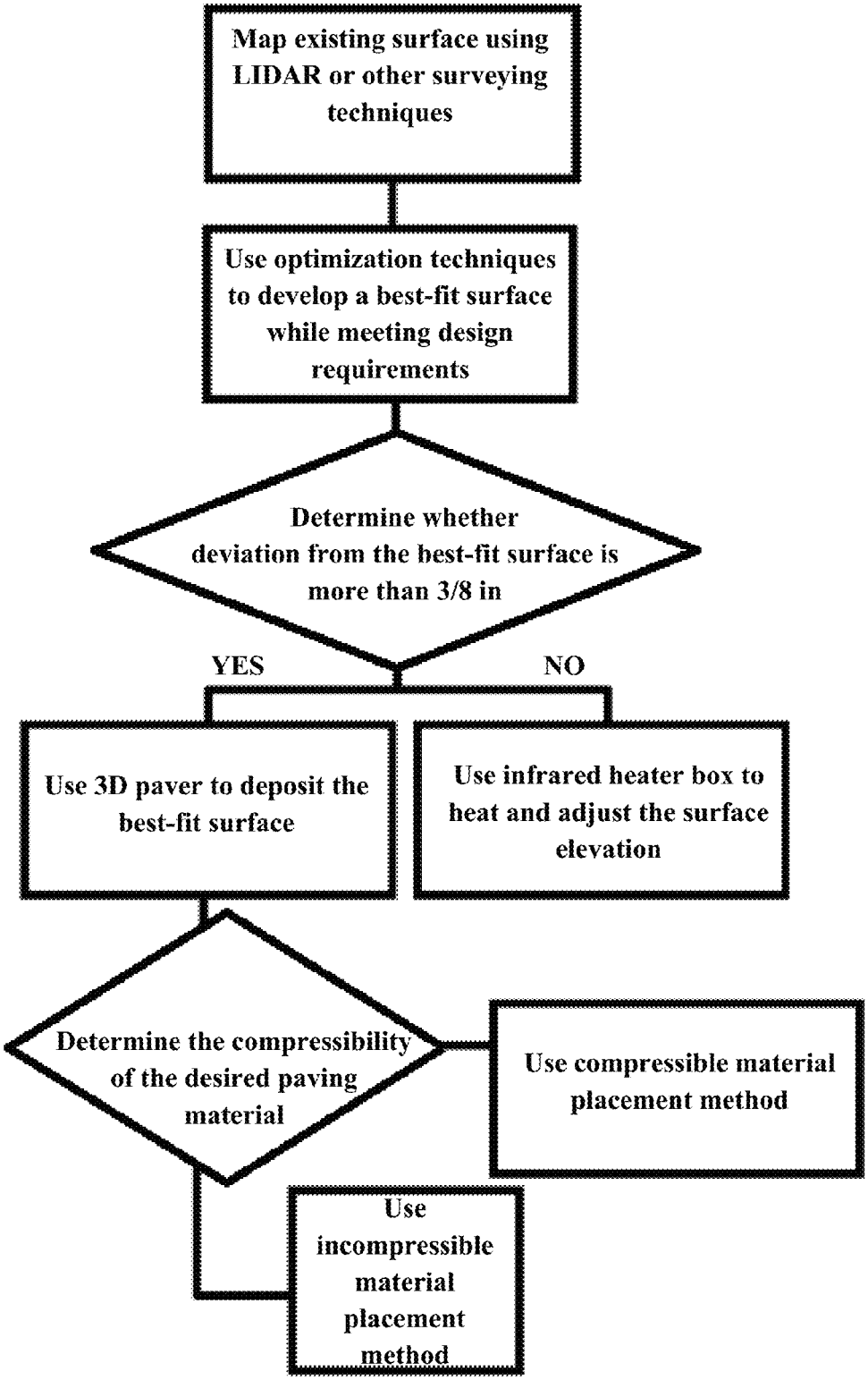
FIG. 1 is a flow chart that outlines exemplary embodiments of the 3-D paving technology of the subject invention.

The subject invention provides methods of preparing and/or modifying a working area of interest that results in a level surface layer.

In specific embodiments, a three-dimensional (3-D) printer can be utilized to deposit a compressible paving material of choice, wherein prior to being compacted mechanically the pavement can have a thickness that varies in accordance with the topography of the subgrade surface.

Advantageously, paving methods comprising 3-D printing technology provided herein offer a more effective, economical, and versatile solution in preparing level road surface layers than do existing paving machines.

In accordance with one aspect of the subject invention, a method of paving a level surface layer of a working area is provided, wherein the method comprises:

- creating a reference station in the vicinity of the working area;
- providing a three-dimensional (3-D) mapping of the topography of the working area using a scanner system, the topography comprising a collection of 3-D coordinates at the surface of the working area;
- determining the thickness of the paving material to be deposited based on the numeric comparison between the reference station and each of the 3-D coordinates of the measured topography of the working area, wherein the thickness data and variations thereof across the working area are stored in a computer memory;
- depositing at least one layer of a desired paving material onto the working area using a 3-D printer, the printer being controlled by the thickness data stored in the memory that is adjusted by a predetermined amount in accordance with the compressibility of the paving material; and
- mechanically compacting the deposited pavement to achieve a level surface layer over the working area.

The paving method provided herein can be applied to a range of surfaces in outdoor environment and enclosed structures. Non-limiting examples of surfaces include road subgrades, parking lots, sidewalks, patios, foundations for houses and courtyards. In specific embodiments, the paving technology provided herein can be applied to repair and/or rehabilitate existing paved surfaces where damage such as potholes and bird baths that can lead to water pooling are present.

In some embodiments, the 3-D scanner system utilizes one or more sensors and devices including, but not limited to, optical sensors, acoustic sensors, GPS systems, and automated total station systems. Other instruments applicable for surveying, mapping, and autonomous navigation can also be used to evaluate the topography of the working area. These instruments can capture 3-D coordinates in rapid succession and render a point cloud that, upon digital processing, graphically represent the topography of the area over which measurements are made.

In a specific embodiment, a LIDAR system can be used to measure the 3-D topography of the working area. LIDAR systems employ high-frequency light waves in the ultraviolet, visible, and infrared regions of the electromagnetic spectrum to accomplish the measurement of distance. A typical LIDAR system comprises a transmitter, a receiver, and a detector. The basic concept of a LIDAR system involves a pulsed laser signal that is focused through a lens or an assembly of lenses before reaching the object whose position is to be measured. The time it takes for that pulse of light to return to the detector is then used to measure the distance between the object and the LIDAR system. When multiple pulses are emitted in rapid succession, and the direction of those emissions is sequentially varied, each distance measurement can be considered a pixel, and a collection of pixels emitted and captured in rapid succession forms a point cloud, which can be rendered as an image or analyzed for other reasons such as detecting obstacles.

In certain embodiments, the thickness of the paving material to be deposited varies according to the topography of the working area as determined by the 3-D scanner. Specifically, the thickness is defined as the numeric difference between the measured height value of each 3-D coordinate in the point cloud and a reference station, which is located in the vicinity of the working area that is positioned at the same elevation as the final paved surface.

A reference station is a point with a known set of X, Y and Z coordinates, typically chosen at the beginning of the section, where X represents the longitudinal direction, Y represents the transverse direction, and Z represents elevation. LIDAR measurements reflect the relative distance in 3-D between points of interest and the reference station without suggesting the absolute location of each point. Therefore, it is necessary to determine a reference station before surveying the working area with a laser profiler in order to ascertain the location of the pavement defects needing repairs. In an exemplary embodiment where the working area is a road, the location of a reference station can be located in the shoulder of the road and away from traffic. The 3-D coordinates of the reference station is subsequently determined using conventional surveying methods.

In some embodiments, the paving material is compressible. Non-limiting examples of compressible paving materials include asphalt, rubber, and mixtures thereof. In an exemplary embodiment, the paving material is asphalt, particularly hot mix asphalt (HMA), which is a combination of stone, sand, and/or gravel bound together by asphalt cement.

In preferred embodiments, the thickness of the surface layer to be deposited depends upon the degree of compressibility of the paving material after rolling. As an example, typical asphalt used for paving road surfaces compresses by about 20% in thickness after the surface is mechanically rolled. As a result, the thickness of the surface layer 105 needs to be approximately 20% greater than the thickness calculated from the 3-D position data in order to maintain a level surface 107 after rolling is completed. This is to be contrasted with conventional paving technology, which employs a screed to apply the paving material, resulting in a level surface prior to compaction 101. Subsequent mechanical rolling compresses the deposited pavement leaving behind a final surface topography 103 resembling that of the subgrade structure 104.

In other embodiments, the paving material is incompressible. Non-limiting examples of incompressible paving materials include concrete, polymer resin, stones, and polymerized cold mixes. Due to their incompressibility, it is not necessary to budget for additional layer thickness resulting from compression after compaction. In addition, the use of a 3-D printer equipped with a nozzle can be electronically controlled to allow deposition of incompressible paving material with a thickness less than ½ of an inch. In specific embodiments, the thickness of the pavement that can be deposited using methods provided herein can be as low as ⅜ of an inch.

In preferred embodiments, the 3-D printer comprises a positioning system and a dispensing system, wherein the dispensing system further comprises a nozzle intake component, a hose, and a nozzle tip, wherein the positioning system is controlled electronically to move the nozzle tip in vertical, longitudinal, and transverse directions, and wherein the sizes of the nozzle intake, the hose, and the tip are selected to accommodate the nominal maximum aggregate size of the desired paving material.

Figure 3:
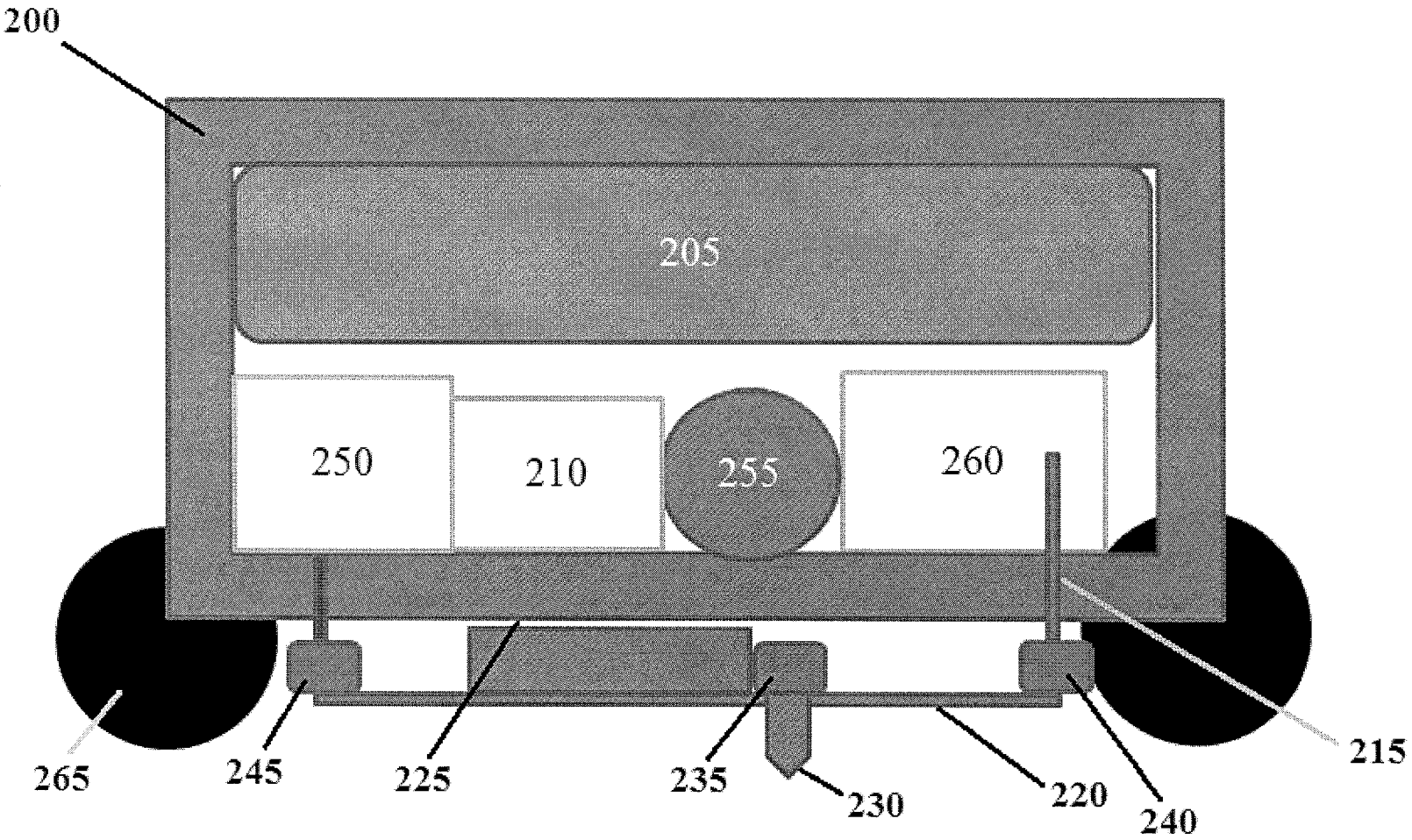
FIG. 3 shows a schematic representation of an embodiment of the 3-D paver according to the current invention.

In some embodiments, the positioning system is driven by a hydraulic motor system which is controlled by a built-in computer equipped with GPS 225. As an exemplary embodiment, FIG. 3 depicts a paving machine 200 that comprises, in addition to the positioning and dispensing systems, an aggregate mixer or hot mix hopper 205, which can include an aggregate bin, emulsion tank, water tank, filler tank, and pugmill, a hydraulic pump 210, vertical and horizontal guides 215, 220 for the positioning system, and a computer control system 225, a nozzle 230, a hydraulic motor configured to move the frame in a longitudinal (X) direction 235, a hydraulic motor configured to move the frame in a transverse (Y) direction 240, a hydraulic motor configured to move the frame in a vertical (Z) direction 245, a material pump 250, a fuel tank 255, and an engine 260 all housed in a motorized vehicle including a vehicle frame equipped with hydraulically propelled tires 265. In an exemplary embodiment, the paving material can be a microsurfacing mix that comprises polymerized asphalt emulsion, water, fine aggregates, mineral fillers, and additives. The consistency of the mix, as measured by the slump test, is approximately 4±0.5 inches with a nominal maximum aggregate size of about 4.75 millimeter, or about 3/16 inch. The diameter of the nozzle intake and the hose is approximately 4 times the nominal maximum aggregate size while the diameter of the nozzle tip is about 2.5 times the nominal maximum aggregate size. Further, the pressure applied should be adjusted to maintain reasonable productivity and paving speed, e.g., more than 12 ft/min, but not too large as to cause the mix to segregate.

The flow chart in FIG. 1 outlines exemplary embodiments of the 3-D paving technology of the subject invention.

Advantageously, embodiments of the paving method provided herein offer electronic control of the 3-D thickness of the surface layer, which is programmed according to the nature of the pavement defects as well as the mechanical properties and aggregate size of the paving material. Further, in accordance with preferred embodiments, a 3-D printer comprising a nozzle and a series of positioning elements can be used to dispense the paving material in desired thickness, which can be as thin as, for example, 1/4, 3/8, or 1/2 of an inch, over a working area. Technology provided herein are effective in providing thin corrections to defected pavement without incurring the large cost that is typical with existing mechanical paving systems.

The step-wise process described below illustrates exemplary embodiments of the paving method of the subject invention involving the use of 3-D printing technology. These exemplary embodiments should not be construed as limiting the scope of the subject invention.

Example 1

First, a parking lot is surveyed using a LIDAR system that produces a 3-D mapping of the parking surface. Data collected using the LIDAR system comprises a point cloud of coordinates representing the overall topography of the parking lot with respect to the position of a reference station chosen in the vicinity of the parking lot.

Second, based on the 3-D topography of the parking lot, the thickness of asphalt needed to be deposited is calculated and optimized to meet a number of criteria including, but not limited to, minimizing the final thickness of the pavement, eliminating the occurrence of water pooling on the finished surface, and introducing cross slopes to promote better drainage of the finished surface.

Figure 2A:
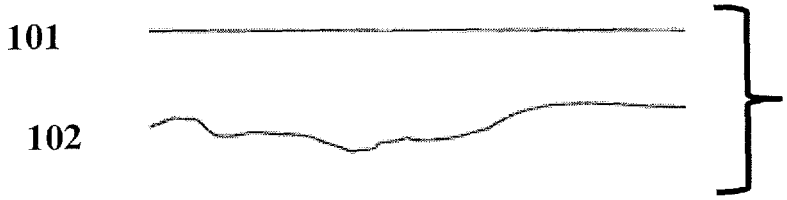
FIGS. 2A-2D demonstrate the significant improvement resulting from using a 3-D printer and the ability to apply a variable thickness solution that, when compacted, produces a level road surface.
Figure 2B:
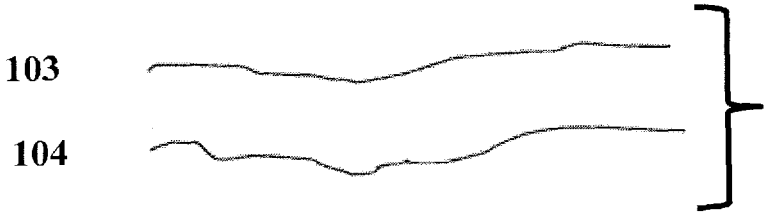

Because the conventional method utilizes a two-dimensional screed to lay down an initially flat surface, parts of the new pavement covering more depressed topographical features are compressed more following compaction (FIG. 2A). The result is a surface that mirrors the subgrade profile, but to a lesser degree (FIG. 2B).

Third, a 3-D printer fitted with a nozzle of a suitable size such as, for example, 2.5 times the nominal maximum aggregate size of the hot mix asphalt is used. The asphalt deposition is precisely computer-controlled to achieve the surface layer determined in Step 2.

Figure 2C:
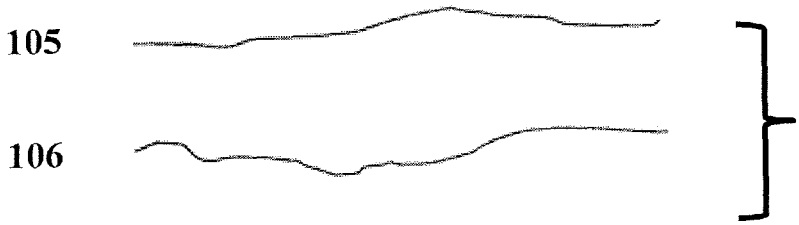
Figure 2D:
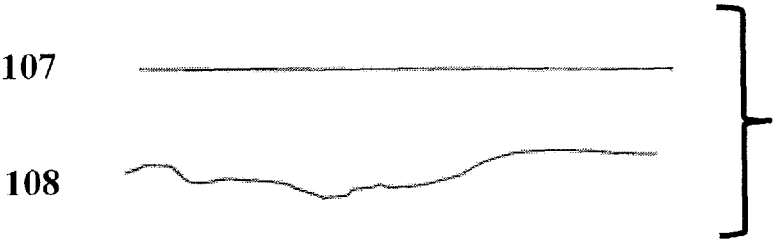

Typically, asphalt is compressed by approximately 20% of its pre-compacting thickness after mechanical rolling. Thus, the thickness of the pavement to be deposited is determined to be a thickness such that, when compressed by 20%, it will match the thickness data obtained based on the 3-D dataset, yielding a level pavement surface layer (FIGS. 2C and 2D).

All patents, patent applications, provisional applications, and publications referred to or cited herein are incorporated by reference in their entirety, including all figures and tables, to the extent they are not inconsistent with the explicit teachings of this specification.

The examples and embodiments described herein are for illustrative purposes only and various modifications or changes in light thereof will be suggested to persons skilled in the art and are included within the spirit and purview of this application. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

What is claimed is:

1. A method of creating a level surface layer of a working area, comprising:

identifying a reference station in the vicinity of the working area;

providing a three-dimensional (3-D) mapping of the topography of the working area using a scanner system, the topography comprising a collection of 3-D coordinates at the surface of the working area;

determining the thickness of a paving material to be deposited based on the numeric comparison between the reference station and each of the 3-D coordinates of the measured topography of the working area, wherein the thickness data and variations thereof across the working area are stored in a computer memory;

depositing at least one layer of the paving material onto the working area using a 3-D printer, the printer being controlled by the thickness data stored in the memory that is adjusted by a predetermined amount in accordance with the compressibility of the paving material, the 3-D printer comprising a positioning system and a dispensing system, the dispensing system comprising a nozzle intake component, a hose, and a nozzle tip, and the positioning system being controlled electronically to move the nozzle tip in vertical, longitudinal, and transverse directions, wherein the sizes of the nozzle intake, the hose, and the nozzle tip are selected to accommodate the nominal maximum aggregate size of the desired paving material; and mechanically compacting the deposited pavement to achieve a level surface layer over the working area.

2. The method according to claim 1, wherein the working area is a road surface.

3. The method according to claim 1, wherein the scanner system utilizes an optical sensor, an acoustic sensor, a global positioning system, or an automated total station system.

4. The method according to claim 3, wherein the 3-D topography of the working area is obtained using a LIDAR system.

5. The method according to claim 1, wherein the paving material is compressible.

6. The method according to claim 5, wherein the paving material is asphalt.

7. The method according to claim 1, wherein the paving material is incompressible.

8. The method according to claim 7, wherein the paving material is concrete, polymer, or a polymerized cold mix for microsurfacing.

9. The method according to claim 7, wherein the thickness of the deposited paving material is as thin as ⅜ of an inch.

10. The method according to claim 9, wherein the thickness of the deposited paving material is less than 1 inch.

11. A method of creating a level surface layer of a working area, comprising:

identifying a reference station in the vicinity of the working area;

providing a three-dimensional (3-D) mapping of the topography of the working area using a LIDAR system, the topography comprising a collection of 3-D coordinates of the surface of the working area;

determining the thickness of a desired paving material to be deposited based on the numeric comparison between the reference station and each of the 3-D coordinates of the measured topography of the working area, wherein the thickness data and variations thereof across the working area are stored in a computer memory;

depositing at least one layer of the paving material onto the working area using a 3-D printer, the printer being controlled by the thickness data stored in the memory that is adjusted by a predetermined amount in accordance with the compressibility of the paving material, wherein the 3-D printer comprises a positioning system and a dispensing system, the positioning system being controlled electronically to move components of the dispensing system in vertical, longitudinal, and transverse directions, and the dispensing system further comprising a nozzle intake component, a hose, and a nozzle tip, wherein the sizes of the nozzle intake, the hose, and the nozzle tip are selected to accommodate the nominal maximum aggregate size of the paving material; and mechanically compacting the deposited pavement to achieve a level surface layer over the working area.

12. The method according to claim 11, wherein the paving material is compressible.

13. The method according to claim 12, wherein the paving material is asphalt.

14. The method according to claim 11, wherein the paving material is incompressible.

15. The method according to claim 14, wherein the paving material is concrete, polymer, or polymerized cold mix for microsurfacing.

16. The method according to claim 11, wherein the thickness of the deposited paving material is at least ⅜ of an inch.

17. A three-dimensional (3-D) printing system for paving a level surface, comprising a positioning system and a dispensing system housed together in a motorized vehicle, the positioning system being controlled electronically to move components of the dispensing system in vertical, longitudinal, and transverse directions, the dispensing system further comprising a nozzle intake component, a hose, and a nozzle tip, wherein the sizes of the nozzle intake, the hose, and the nozzle tip are selected to accommodate the nominal maximum aggregate size of a desired paving material.

18. The printer system according to claim 17, further comprising at least one of the following components: a hydraulic motor system controlled by the positioning system, an aggregate mixer, a hydraulic pump, vertical and horizontal guides for the positioning system, and a computer control system.

19. The method of claim 1, further comprising:

using optimization techniques to develop a best-fit surface;

determining whether a deviation from the best-fit surface is less than 0.5 inches; and using an infrared heater box to adjust the surface elevation.

* * * * *